US005154954A

United States Patent [19]

Croop et al.

[11] Patent Number: 5,154,954

[45] Date of Patent: Oct. 13, 1992

[54] ELECTRICAL INSULATION, MANUFACTURING METHOD, AND USE THEREOF

[75] Inventors: Edward J. Croop, Pittsburg; Thomas S. Snyder, Oakmont; Dean C. Westervelt, Acme, all of Pa.

[73] Assignee: AEG Westinghouse Transportation Systems, Inc., Pittsburgh, Pa.

[21] Appl. No.: 501,292

[22] Filed: Mar. 19, 1990

[51] Int. Cl.[5] ..... A47G 19/22

[52] U.S. Cl. ..... 428/34.5; 427/381; 427/388.1; 427/389.8; 428/34.6; 428/34.7; 428/36.1; 428/36.3; 428/240; 428/241; 428/253; 428/254; 428/256; 428/268; 428/273; 428/283; 428/285; 428/290; 428/324; 428/325; 428/375; 428/379; 428/402; 428/406; 428/920

[58] Field of Search ..... 428/290, 240, 241, 256, 428/268, 273, 285, 253, 254, 375, 379, 406, 324, 325, 402, 34.5, 920, 34.6, 34.7, 36.1, 36.3, 283; 427/388.1, 389.8, 381

[56] References Cited

U.S. PATENT DOCUMENTS 4,944,974 7/1990 Zachariades ..... 428/36.1

OTHER PUBLICATIONS

D. C. Bradley et al., "Metal Alkoxides", Academic Press, 1978.

David W. Johnson, Jr., "Sol-Gel Processing of Ceramics and Glass", Am. Ceram. Soc. Bull., vol. 64, No. 12, pp. 1597-1602, 1985.

*Primary Examiner*—James J. Bell

*Attorney, Agent, or Firm*—Spencer, Frank & Schneider

[57] ABSTRACT

Electrical insulation which has good dielectric strength, good radiation resistance, and good thermal resistance at temperatures of up to 500° C. and, preferably up to 1700° C., includes a substrate which is flexible, has the form of a filament, sheet, wrapper, tape or sleeve, and consists essentially of inorganic materials selected from the group consisting of inorganic fibers and metals, metalloids, or alloys; and at least one layer of at least one oxide of an alkoxide-forming element provided on the substrate to impregnate and/or coat same. The insulation is prepared by a process including applying a solution containing an alkoxy gel polymer, optionally additionally containing at least one inorganic material in finely divided form, to the substrate to provide a treated substrate useful as a preform when allowed to set under ambient conditions. The preform is applied to a part by, for example, wrapping, and is heated to pyrolyze the alkoxy gel polymer to its oxide and provide electrical insulation consisting essentially of inorganic materials. The application and pyrolysis steps may be repeated to build up the thickness of the at least one oxide.

22 Claims, 1 Drawing Sheet

ELECTRICAL INSULATION, MANUFACTURING METHOD, AND USE THEREOF

BACKGROUND OF THE INVENTION

1. Field of the Invention

The present invention relates to insulation of parts for electrical equipment, particularly to electrical insulation of parts for high performance electrical equipment requiring operational reliability at temperatures in excess of that afforded by conventional Class H 220° C. insulation and, more particularly, to electrical insulation in the form of a filament, sheet, wrapper, tape or sleeve which is a flexible composite preform and which is composed entirely of inorganic materials after sintering.

2. Description of the Related Art

Insulation composed of significant quantities of inorganic dielectric materials, such as ceramics including glass and refractories, exhibits poor strength, is not flexible, is difficult to fabricate, and shatters easily. These poor mechanical characteristics have heretofore precluded use of significant quantities of inorganic dielectric materials in electrical insulation for parts for electrical equipment, such as motors. In particular, exclusive use of inorganic dielectric materials for electrical insulation has been limited to only a few specific applications. This is so despite superior properties including uniquely high operating temperatures and advantageous dielectric strength, dielectric constant, and power loss factor, as shown in Table I. Table I compares the properties of various known electrical insulating materials, the data coming from several sources as footnoted.

TABLE I

| Electrical Insulating Materials | Dielectric Constant | Power Factor | Softening or Decomposition Temp. °C. |
|---|---|---|---|
| Rubber (Neoprene) | 2-3 | 0.005-0.01 | 90 |
| Mica/Mica Compounds | 5-8 | $1\text{-}3 \times 10^{-4}$ | — |
| Insulating Varnishes | 6 | 0.030 | 150 |
| Impregnating Compounds (Bitumens & Waxes) | 3 | 0.003 | 40 |
| Impregnated Fabrics glass, with polyester resin | 2.5-5.0 | 0.025-0.10 | 70 |
| Chlorinated Hydrocarbons (PVC) | 3-12 | 0.063 | 90 |
| Thermosetting Substances (phenol aldehyde type) | 5-6 | 0.025 | 200 |
| Thermoplastic Resins | | | |
| Polyethylene | 2.28 | .0003 | 99-116 |
| Teflon | 2.0-2.3 | <0.10 | 400 |
| Paper | 1-6 | $0.02^{+}$ | — |
| Ceramics/Glasses | 4-6 | $6 \times 10^{-4}$ | 800-1500 |
| Polymeric Films | | | |
| (polyesters | 3.2 | 0.003 | 150 |
| fluorocarbons) | 2.0 | <0.0002 | 380 |
| Nylon | 3.9-7.6 | 0.08-.1 | 198-249 |

Data from: Clark, F. M., Insulating Materials for Design & Engineering Practice. von Hipple, A. R., Dielectric Materials & Applications. Modern Plastics.

SUMMARY OF THE INVENTION

It is an object of the present invention to provide a method of manufacturing electrical insulation employing sol-gel processing techniques using a solution containing an alkoxy gel polymer of at least one alkoxide-forming element to impregnate and/or coat a substrate comprising inorganic materials, such as inorganic fibers or a metal foil or mesh.

It is another object of the present invention to provide an electrical insulation preform according to the above method which is flexible and which may be applied to a part to be insulated, and then heated to pyrolyze the alkoxy gel polymer thereof and provide electrical insulation consisting essentially of inorganic materials.

It is yet another object of the present invention to provide electrical insulation which consists essentially of inorganic materials, is sufficiently resilient to withstand operational vibration due to mechanical, electrical, and magnetic forces, and is able to withstand operating temperatures in use of up to 500° C., preferably up to 1,700° C., most preferably up to 2,000° C.

It is yet another object of the present invention to employ such an electrical insulation or electrical insulation preform to provide electrical insulation, as well as thermal and high energy radiation insulation, for a part for electrical equipment, especially high performance electrical equipment requiring high operational reliability even at operational temperatures in excess of conventional Class H 220° C. insulation, such as at temperatures of 500° C. or more.

These and other objects of the invention are accomplished by providing an electrical insulation preform which is flexible and includes a substrate which is flexible, has the form of a filament, sheet, wrapper, tape or sleeve, and is comprised of at least one kind of inorganic fiber; and an alkoxy gel polymer of at least one alkoxide-forming element, e.g., metal or metalloid, provided on the substrate to impregnate and/or coat same.

The substrate is preferably a fabric, except when the substrate is a filament, and has a form selected from the group consisting of a woven fabric, a knitted fabric, a braided fabric, and a fabric composed of matted fibers. Such a substrate is composed of at least one kind of inorganic fiber, such as fibers of glass, silica, zirconia, and hafnia, and, optionally a small amount of organic or inorganic binder material may be included, particularly if the fabric is composed of matted fibers. This embodiment of the invention contemplates use of any kind of fiber-forming inorganic material having sufficient dielectric strength and heat resistance, whether amorphous or crystalline, including materials devitrified to varying degrees, such as glass ceramics. Such materials typically fall within the broad category of ceramics and include glass products of all types and refractories, i.e., refractory metal oxides.

Crystalline and amorphous materials derived from polymerized alkoxides prepared using sol-gel processing technology are known (see, for example, Johnson, Jr. D. W., "Sol-Gel Processing of Ceramics and Glass", *Am. Ceram. Soc. Bull.*, Vol. 64, No. 12, pps. 1597-1602 (1985) the disclosure of which is herein incorporated by reference). The practical use of such materials in industrial applications, however, is a developing area of technology.

The term "alkoxide-forming element" as used herein refers to any element of the Periodic Table Of Elements which is capable of forming an alkoxide. Such elements include a large number of metals and metalloids. For convenience, such materials may be said to have the general formula $M(OR)_x$, in which M is, for example, a metal or metalloid, R is an alkyl group, e.g., $C_yH_{2y+1}$, and x is the ionic valence of M. The alkoxide chemistry of almost all metallic and metalloidal elements has been studied as reported in Bradley, D. C., et al., *Metal Alkoxides,* Academic Press, (1978), the disclosure of which is herein incorporated by reference, particularly the Periodic Table on page 1 which includes a heavy line framework delineating for which elements alkoxide chemistry ha been studied and reported in the literature.

Polymerized alkoxides useful in the present invention include those having single or multiple alkoxide components, as well a those including metal salt components along with the alkoxides which form the network of the gel. Such metal salt components are typically soluble metal salts which can be used to introduce modifier ions into the gel structure to advantage, such as for minimizing migration to the surface of certain soluble ions during drying which could otherwise undesirably leave a concentration gradient within the dried body.

Useful alkoxide-forming elements for the present invention include virtually any such element after the Periodic Table, but preferably are metals or metalloids and. most preferably, are those selected from the group consisting of Sr, Y, Ti, Zr, Hf, Ta, W, Ni, Al, Ga, Tl, Si, Ge and Te. The alkoxy gel polymer may be, for example, hydrolyzed and polymerized tetraethylorthosilicate.

These materials are formed by reaction of an alkoxide-forming metal or metalloid with an alcohol according to equations (1) or (2) depending on the alkoxide-former's reactivity as is well known:

$$M + nROH \rightarrow M(OR)_n + n/2\ H_2 \quad (1)$$

$$MCl_x + x\ ROH \rightarrow M(OR)_x + x\ HCl \quad (2)$$

Synthesis begins with alkoxide starting materials of the form $M(OR)_x$, where M is any alkoxide-forming metal or metalloid and R represents an alkyl group, e.g., $C_xH_{2x+1}$. After dilution with a compatible carrier fluid, for example, a matching alcohol, the alkoxide is partially hydrolyzed according to the reaction of equation (3):

$$M(OR)_x + yH_2O \rightarrow M(OR)_{x-y}OH_y + yROH \quad (3)$$

With the onset of hydrolysis, however, a competing reaction, polymerization, occurs according to the reaction of equation (4):

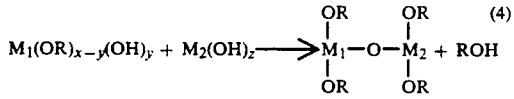

(4)

The kinetics of these competing reactions depend on the concentration of the starting materials, the composition of the diluting fluid, the temperature of the system, the amount of hydrolysis water, and the presence or absence of a catalyst. Consequently these factors become important determiners of the structure of the resulting polymer.

Moreover, since alkoxide groups withdraw electrons; the metal or metalloid in the center thereof begins to appear as though it has a positive charge. This charge allows a weak attraction to oxygen linkages in other alkoxides provided stearic hindrance does not prohibit the intermolecular interaction. Both single and mixed alkoxides having the following structure can be formed from mixtures of monomers. In the alkoxide structure (5), various molecular entities are shown joined by weak attractive forces including hydrogen bonding, van der Waals forces, or polar interactions, in which the arrows indicate intermolecular interaction:

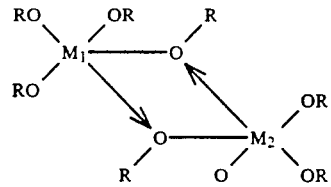

(5)

The resulting polymer may be characterized by the ratio of bridging to nonbridging oxygens. In alkoxide-derived $SiO_2$ for example, increasing the amount of hydrolysis water in the precursor solution equation (3) promotes the formation of oxygen bridges and leads to a clear glassy product, fused silica, upon pyrolysis at 500° C. to sinter the silicon-based alkoxy gel polymer to $SiO_2$.

The term "sol" generally refers to a mixture of solid colloidal particles in a liquid. In the field of ceramics including glass, "sol-gel" has come to have a broader meaning and includes the use of organometallics, such as alkoxides, which can be partly hydrolzyed and then polymerized into a uniformed gel even though a sol in the classical sense, i.e., a colloidal sol, may never have existed. Thus, as proposed in the Johnson article mentioned in the foregoing, the term "sol-gel" can better be thought of as an abbreviation of "solution gelation".

Sol-gel processing is amenable to the deposition of thin films onto and/or impregnation within virtually any substrate because the precursor polymerized alkoxide solution is easily applied by any of several well-known means including, dipping, drawing, knifing, rolling, spraying, or spin-coating. Once wetting is established, good adhesion generally follows, because shrinkage occurs isotopically. For this reason, sol-gel coatings have been successfully applied on substrates in spite of eve significant thermal expansion mismatch.

In one experiment, for example, 20 layers of $SiO_2$ (0.4 μm each) were sequentially applied to a substrate of 304 stainless steel having a thickness of about 10 mils and adhered well even when the substrate was deformed by bending up to 135°. Furthermore, the steel was protected from oxidation by the layers during the sequential 500° C. heat treatments in air which were used to pyrolyze the sequentially-applied layers to provide successive layers of $SiO_2$.

The term "flexible" as used herein generally means flexible enough for its intended purpose. Thus, a flexible substrate is one which is flexible enough to be applied to a part to be insulated. A substrate, for example, may range from about 0.1 μm to about 10 mm in thickness or diameter, or thicker if it is a flat sheet to be inserted between conductors but not wrapped. A fabric substrate may range from about ½ mil to about 30 mils; a metal foil substrate may range from about ½ mil to about 6 mils. The alkoxy gel polymer or oxide thickness may range from the thickness required to form a pin-hole-free impregnate within a porous substrate up to the thickness required to totally fill the porous substrate. When the oxide is a coating on the substrate, the thickness may range from about 0.4 μm for one layer up to the thickness of the substrate for a plurality of layers.

Preferably, the alkoxy gel polymer of an underlying layer is heated to pyrolyze it to the oxide before the next layer of alkoxy gel is applied. This means the preform becomes progressively less flexible as the number of layers applied and pyrolyzed to the oxide increases. The alkoxy gel polymer layer itself is quite flexible so that a preform having one impregnation or layer of the alkoxy gel polymer is about as flexible as the substrate itself.

The objects of the invention are additionally accomplished by providing an electrical insulation preform which is flexible and includes a substrate which is flexible, has the form of a filament, sheet, wrapper, tape, or sleeve and is comprised of at least one kind of metal; and an alkoxy gel polymer of at least one alkoxide-forming element, e.g., metal or metalloid, provided on the substrate to impregnate and/or coat same.

The substrate may be a metal filament, such as a wire or bundle of wires; a metal sheet, wrapper, or tape, such as a foil or mesh; or a metal sleeve, such as a braided tube or a tube formed by joining a rectangular metal foil along its longitudinal edges. As used herein, the term "metal" is meant to include a metal, a metalloid, mixtures thereof, and alloys thereof, as well as complex mixtures and alloys thereof including more than one metal and/or metalloid and, optionally, one or more additional elements of the Periodic Table.

The objects of the invention are additionally accomplished by providing a process for preparing electrical insulation, the process including applying a solution containing an alkoxy gel polymer of at least one alkoxide-forming element, e.g., metal or metalloid, to a substrate which is flexible, has a form selected from the group consisting of a filament, sheet, wrapper, tape, or sleeve, and consists essentially of at least one kind of inorganic material which is at least one kind of inorganic fiber or at least one kind of metal, to impregnate and/or coat the substrate and provide a treated substrate; and allowing the alkoxy gel polymer of the treated substrate to set under ambient conditions of temperature and pressure, and provide an electrical insulation preform which is flexible.

The alkoxy gel polymer is in solution, for example, in an alcohol, and may be diluted with a compatible carrier fluid, for example, a matching alcohol. Thus, application of the alkoxy gel polymer may be by any suitable well-known coating method including dip coating, draw coating, knife coating, roller coating, spray coating or spin coating. In this manner, the substrate is impregnated and/or coated with the alkoxy gel polymer. More than one application may be necessary to provide the desired thickness of material. Before applying a subsequently applied alkoxy gel polymer layer, preferably the underlying alkoxy gel polymer impregnated/-coated substrate is heated to pyrolyze the alkoxy gel polymer to its oxide, followed by cooling. This results in the best, pin-hole-free impregnation/coating.

The process may further comprise the step of dispersing at least one inorganic filler material in finely divided form within the solution containing the alkoxy gel polymer prior to applying the polymer to the substrate. Dispersion is preferably uniform so that the coated alkoxy gel polymer has a uniformly distributed filler material therein. Useful inorganic filler materials include natural or synthetic electrical insulators, such as, for example, pulverized mica, glass, and refractories. Useful inorganic filler materials additionally include microspheres of glass which may be, moreover, hollow or solid spheres and the term "finely divided" is intended to include microspheres, as well as particulates including powders.

The term "finely divided" as used herein refers to a powder filler material having a particle size ranging from about 0.0001 μm up to about 10 mm, but in any event, not exceeding the thickness of the oxide coating on the thickness of the substrate. When the filler materials are microspheres, the diameter of the spheres ranges from about 0.001 μm up to about 10 mm, but, in any event, does not exceed the thickness of the oxide coating or the thickness of the substrate.

The process according to the invention may further comprise the step of drying the alkoxy gel polymer of the treated substrate by thermal means to remove solvent either with or without allowing the alkoxy gel polymer to set at ambient. Drying may be accomplished by heating to a temperature above the boiling point of the solvent(s) employed. Where the solvents are alcohol, possibly also containing water, gentle warming above 100° C., for example, generally suffices to evaporate the solvents and dry the alkoxy gel polymer but without pyrolyzing the alkoxy gel polymer.

The process may further comprise the step of heating the electrical insulation preform at a temperature effective to pyrolyze the alkoxy gel polymer to at least one oxide of the at least one alkoxide-forming element thereof and provide electrical insulation consisting essentially of inorganic materials.

The invention includes the process of electrically insulating a part for use in electrical equipment, such as a motor or a wire member. The process of use includes the steps of applying to the part an electrical insulation or preform as in the foregoing to provide an assembly. Application to the part is accomplished, for example, by inserting a flat sheet, or by wrapping a sheet, wrapper, or tape therearound, or sliding a sleeve thereover, or serving a filament around the part, for example, a wire member. Next, the assembly is heated to pyrolyze the alkoxy gel polymer of the preform to at least one oxide of the alkoxide-forming metal or metalloid thereof and to provide electrical insulation consisting essentially of inorganic materials.

When the substrate is a filament, the electrical insulation or preform is served, i.e., wound around, for example, a wire member of the electrical equipment. When the substrate is a sheet, it may be inserted between, for example, conductors without any substantial wrapping. This is distinguishable from a wrapper which is a sheet, such as a rectangular sheet, which is wrapped around the part at least once. A wrapper, for example, may be wrapped around a coil phase nested in a slot and tied with a string to hold the wrapper in place, as is well known in the art. In such an application, the wrapper insulates a portion or group of coils which reside in the slots of a magnetic steel structure. When the substrate is a tape it is typically wrapped spirally, overlapping around a part, and when a sleeve, such as a tubular sleeve or sleeving, made of a joined sheet, or made by braiding, knitting, and the like, it is generally slid over the part to surround it.

Pyrolyzing such an electrical insulation preform assumes, of course, that the part to be electrically insulated can withstand the temperatures required for pyrolysis. Clearly the present invention is seeking to completely pyrolyze the alkoxy gel polymer to its oxide so that the resulting electrical insulation contains only inorganic materials. Typical temperatures range between 500° and 1000° C. depending on the nature of the organometallic, i.e., alkoxide, being pyrolyzed.

Of great significance is the fact that the pyrolyzing temperature required is generally well below the melting temperature for the equilibrium crystal phase and/or below the typical working temperatures for the materials as described in the above-referred-to Johnson article.

Instead of providing a preform, the present invention additionally contemplates direct formation of electrical insulation which consists essentially of inorganic materials. Such electrical insulation includes a substrate which has the form of a filament, sheet, wrapper, tape, or sleeve, and consists essentially of at least one kind of inorganic material selected from at least one kind of inorganic fiber or at least one kind of metal. The electrical insulation additionally includes at least one oxide of at least one alkoxide-forming element provided on the substrate impregnate and/or coat same.

Pyrolyzed electrical insulation according to the invention has less flexibility than the preform particularly as the total oxide thickness increases, but even if relatively thick, e.g., about 8.0 microns, it continues to be resilient enough to withstand operational vibration due to mechanical, electrical, and magnetic forces. Such insulation may be used, for example, in a flat sheet to be inserted between, for example, conductors, which does not require any wrapping.

The invention thus provides a process for preparing such electrical insulation and includes the steps of applying a solution containing an alkoxy gel polymer of at least one alkoxide-forming element to a substrate which is flexible, has the form of a filament, sheet, wrapper, tape, or sleeve, and consists essentially of at least one inorganic material selected from at least one kind of inorganic fiber and/or at least one kind of metal fiber to impregnate and/or coat the substrate and provide a treated substrate. The process additionally includes heating the treated substrate at a temperature effective to pyrolyze the alkoxy gel polymer to at least one oxide of the at least alkoxide-forming element and provide the finished electrical insulation.

The process may further comprise the step of allowing the alkoxy gel polymer of the treated substrate to set under ambient conditions of temperature and pressure before the pyrolyzing step. The process may further comprise the step of drying the alkoxy gel polymer to remove solvent therefrom, such as by thermal means, with or without having allowed the alkoxy gel polymer to set. Drying takes place at a temperature effective to substantially remove solvent but below the temperature at which pyrolyzing of the alkoxy gel polymer takes place. The process may further comprise the step of dispersing at least one inorganic filler material in finely divided form within the solution containing the alkoxy gel polymer prior to application thereof to the substrate. Moreover, application of the solution containing the alkoxy gel polymer may be accomplished by any conventional coating method, including but not limited to one of dipping, drawing, spraying, knifing, rolling and spin coating. Use of carrier fluids and/or diluent solvents is clearly anticipated, such solvents including, for example, matching alcohols having alkyl groups which match the alkyl group of the alkoxy gel polymer.

The insulation preform should be at least flexible enough to be bent by 90°. Preferably the preform can be wrapped around a three inch radius, most preferably around a one-half inch radius, especially around a one-quarter inch radius. The thickness of the substrate and of the oxide(s) applied thereon are selected accordingly.

The present invention thus provides an insulation with flexibility sufficient to be applied to a part by wrapping the sheet or tape therearound or by sliding, including bending, a sleeve thereover, and having thermal resistance of at least 500° C. Moreover, if both the fiber and the alkoxide-derived metal oxide is zirconia, particularly if stabilized in the tetragonal form with yttria or other lanthanide oxide, superior thermal resistance of at least 1,700° C. and up to 2,000° C. and even up to 2,500° C. or more is possible.

The alkoxy gel polymer functions as a sealant or coating agent for the fabric substrate and, when the solution containing the alkoxy gel polymer contains additional inorganic materials in finely divided form, the alkoxy gel polymer functions as a binder to hold the finely divided inorganic material therein and bind it to the substrate. Preferably the additional inorganic material is uniformly distributed within the solution containing the alkoxy gel polymer and/or solution thereof, and remains uniformly, i.e., homogeneously, distributed therein after coating and/or impregnation of the substrate, and after pyrolysis.

DESCRIPTION OF THE PREFERRED EMBODIMENTS

Figure 1:
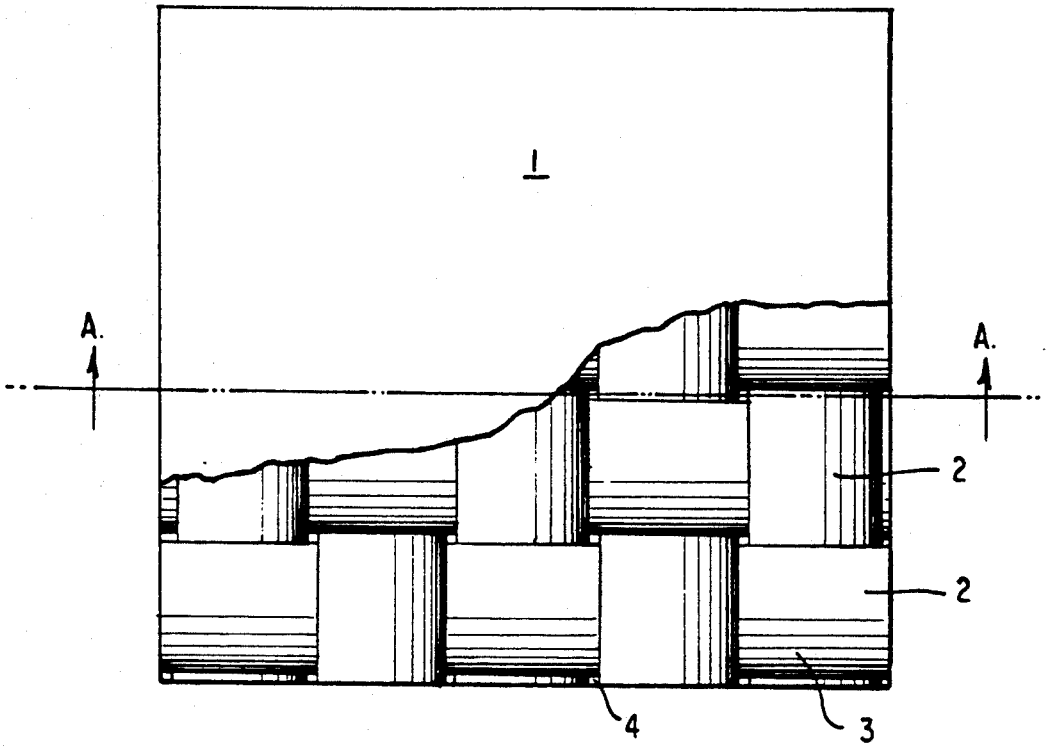
FIG. 1 is a top view in partial cross-section of a sheet of electrical insulation according to the invention.
Figure 2:
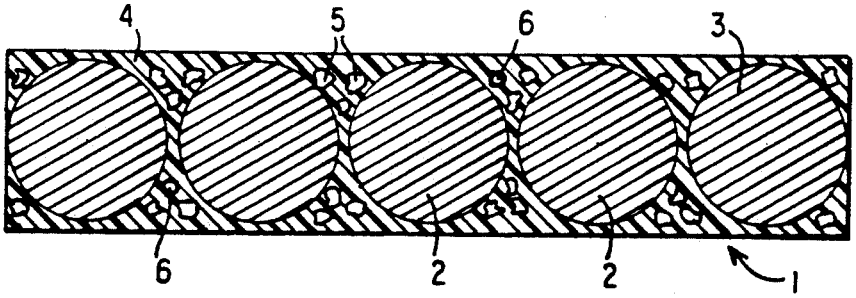
FIG. 2 is a cross-sectional side view of the sheet of FIG. 1 along line A—A.

FIG. 1 is a top view in partial cross-section of a sheet 1 according to the invention. Inorganic fibers 2, of, for example, zirconia are woven into a substrate 3 shown in cross-section in side view FIG. 2 along line A—A as a woven fabric 3. Alkoxy gel polymer 4 is prepared by hydrolyzing and polymerizing, for example, zirconium metal tetraalkoxides. Comminuted inorganic material mica 5 and glass microspheres 6 are dispersed into the gel matrix prior to application thereof onto the woven fabric 3. Before the polymer matrix sets, fabric 3 is dipped in, drawn through, knife coated, roller coated, sprayed or spin-coated with a solution containing the alkoxy gel polymer 4. The treated fabric is allowed to set, is optionally dried by application of heat to remove solvent, and heated to pyrolyze the alkoxy gel polymer to the oxide, for example zirconium oxide.

Figure 3:
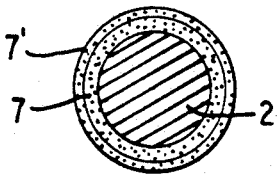
FIG. 3 is a cross-sectional view of a filament coated with two layers of oxide to provide an electrical insulation according to the invention.

FIG. 3 is a cross-sectional view of a filament substrate 2, shown as a wire 2 coated with two layers 7, 7' of at least one oxide of an alkoxy gel polymer after pyrolysis.

Figure 4:
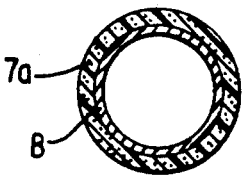
FIG. 4 is a cross-sectional view of an electrical insulation preform according to the invention in the form of a coated sleeve.

FIG. 4 is a cross-sectional view of an electrical insulation preform according to the invention in the form of a coated sleeve. Sleeving substrate 8 is coated with a layer 7*a* of alkoxy gel polymer which has not yet been heated to pyrolyze the alkoxy gel polymer to its oxide(s).

EXAMPLE

A sol-gel having the following constituents was prepared according to the following procedure:

| | |
|---|---|
| Deionized Water | 79.2 grams |
| 200 Proof Ethanol | 250 grams |
| 70 wt % $HNO_3$: | 10 drops |
| Tetraethylorthosilicate: (TEOS) | 416 grams |
| Ethanol (200 proof) | 4.8 grams |
| Total: | 750 grams of 16% $SiO_2$ by weight |

A glass reactor was cleaned and dried and the tare weight was set. Water and ethanol were then weighed into the glass reactor. Nitric acid was added dropwise while the contents were mixed to produce a homogeneous mixture. TEOS was then added as rapidly as possible and absolute ethanol was added to bring the weight up to 750 grams. The reactor was closed and agitated, and was refluxed at the alcohol reflux temperature of the carrier alcohol for from about 1 to about 24 hours.

The melting point data in Table II demonstrate the range of operating temperatures which can be attained with electrical insulation according to the present invention. Table II also demonstrates the variation in electrical properties which are available by selection of materials for the composite. Although these values are included by way of demonstration, alkoxide-derived oxides of any alkoxide-forming metal or metalloid, including alkoxide-forming transition metals outlined in the foregoing process chemistry, may be used.

It will be understood that the above description of the present invention is susceptible to various modifications, changes and adaptations, and the same are intended to be comprehended within the meaning and range of equivalents of the appended claims.

TABLE II

Physical Properties Attainable With Selected Materials From 49th Edition CRC Handbook of Chemistry and Physics

| | | Dielectric Properties | | | |
|---|---|---|---|---|---|
| Compound | Melting Point (°C.) | Dielectric Constant @ $10^6$ Cycles | Strength Volts per Mil | Resist. Ohm-cm 23° C. | σ Loss Factor |
| $SiO_2$ (Mica Glass) | 1700 | 7.4–9.2 | — | $10^{14}$–$10^{17}$ | .0015-.012 |
| $TiO_2$ | 1825 | 15–12,000 | 50–300 | $10^8$–$10^{15}$ | .0002-.005 |
| $Al_2O_3$ | 2045 | 4.5–8.4 | 40–160 | $10^{11}$–$10^{14}$ | .0002-.01 |
| $ZrO_2$/$HfO_2$ (Porcelain Zircon Values) | 2700/2800 | 7.1–10.5 | 250–400 | $10^{13}$–$10^{15}$ | .0002-.008 |

What is claimed is:

1. An electrical insulation preform which is flexible, comprising:
   a substrate which is flexible, has a form selected from the group consisting of a filament, sheet, wrapper, tape, and sleeve, and is comprised of at least one kind of inorganic fiber; and
   an alkoxy gel polymer of at least one alkoxide-forming element provided on the substrate to at least one of impregnate and coat same.

2. The electrical insulation preform according to claim 1, wherein the substrate is selected from the group consisting of a sheet, wrapper, tape and sleeve, and is a fabric selected from the group consisting of a woven fabric, a knitted fabric, a braided fabric and a fabric comprised of matted fibers.

3. The electrical insulation preform according to claim 1, wherein the at least one kind of inorganic fiber of the substrate is selected from the group consisting of glass, silica, zirconia and hafnia.

4. The electrical insulation preform according to claim 1, wherein the alkoxy gel polymer includes at least one alkoxide-forming element selected from the group consisting of Sr, Y, Ti, Zr, Hf, Ta, W, Ni, Al, Ga, Tl, Si, Ge and Te.

5. The electrical insulation preform according to claim 4, wherein the alkoxy gel polymer is tetraethylorthosilicate.

6. The electrical insulation preform according to claim 1, further comprising at least one inorganic filler material in finely divided form distributed within the alkoxy gel polymer.

7. The electrical insulation preform according to claim 6, wherein the at least one inorganic filler material in finely divided form is an electrical insulator selected from the group consisting of mica, glass, and refractories.

8. The electrical insulation preform according to claim 1, further comprising at least one layer consisting essentially of at least one oxide of at least one alkoxide-forming element provided on the substrate to at least one of impregnate and coat same and positioned between the substrate and the alkoxy gel polymer.

9. An electrical insulation preform which is flexible, comprising:
   a substrate which is flexible, has a form selected from the group consisting of a filament, sheet, wrapper; tape, and sleeve, and is comprised of at least one metal; and
   an alkoxy gel polymer of at least one alkoxide-forming element provided on the substrate to at least one of impregnate and coat same.

10. The electrical insulation preform according to claim 9, further comprising at least one layer consisting essentially of at least one oxide of at least one alkoxide-forming element provided on the substrate to at least one of impregnate and coat same and positioned between the substrate and the alkoxy gel polymer.

11. Electrical insulation consisting essentially of inorganic materials, the electrical insulation comprising:
   a substrate having a form selected from the group consisting of a filament, sheet, wrapper, tape, or sleeve, and consisting essentially of at least one kind of inorganic material selected from the group consisting of at least one kind of inorganic fiber and at least one kind of metal; and
   at least one layer of at least one oxide of at least one alkoxide-forming element provided on the substrate to at least one of impregnate or coat same.

12. A process for preparing electrical insulation; comprising:
   a. applying a solution containing an alkoxy gel polymer of at least one alkoxide-forming element to a substrate to at least one of impregnate and coat the substrate and provide a treated substrate, which substrate is flexible, has a form selected from the group consisting of a filament, sheet, wrapper, tape, and sleeve and consists essentially of at least one kind of inorganic material selected from the group consisting of at least one kind of inorganic fiber and at least one kind of metal; and
   b. allowing the alkoxy gel polymer of the treated substrate to set under ambient conditions of temperature and pressure, and provide an electrical insulation preform which is flexible.

13. The process according to claim 12, wherein the solution containing an alkoxy gel polymer contains at least one solvent, and wherein the process further comprises the step of drying the alkoxy gel polymer of the treated substrate after step b by thermal means and at a temperature effective to substantially remove the at least one solvent without pyrolyzing the alkoxy gel polymer.

14. The process according to claim 13, further comprising the step of heating the electrical insulation preform, after drying, at a temperature effective to pyrolyze the alkoxy gel polymer to at least one oxide of the at least one alkoxide-forming element thereof and provide electrical insulation consisting essentially of inorganic materials.

15. The process according to claim 14, further comprising repeating at least one time the steps of, in the order recited, applying the solution, allowing the alkoxy gel polymer to set, drying the alkoxy gel polymer, and heating the electrical insulation preform to pyrolyze the alkoxy gel polymer, in order to provide a treated substrate having an increased quantity of the at least one oxide of the at least one alkoxide-forming element thereof.

16. The process according to claim 12, further comprising the step of heating the electrical insulation preform after step b at a temperature effective to pyrolyze the alkoxy gel polymer to at least one oxide of the at least one alkoxide-forming element thereof and provide electrical insulation consisting essentially of inorganic materials.

17. The process according to claim 16, further comprising repeating at least one time the steps of, in the order recited, applying the solution, allowing the alkoxy gel polymer to set, and heating the electrical insulation preform to pyrolyze the alkoxy gel polymer, in order to provide a treated substrate having an increased quantity of the at least one oxide of the at least one alkoxide-forming element thereof.

18. The process according to claim 12, further comprising the step of dispersing at least one inorganic filler material in finely divided form within the solution containing the alkoxy gel polymer prior to step a.

19. The process according to claim 12, wherein the solution containing the alkoxy gel polymer is applied in step a by a coating method selected from the group consisting of dip coating, draw coating, knife coating, roller coating, spray coating, and spin coating.

20. The process of electrically insulating a part for use in electrical equipment, comprising:

a. applying to the part an electrical insulation preform according to claim 1 to provide an assembly; and b. heating the assembly to pyrolyze the alkoxy gel polymer of the electrical insulation preform to at least one oxide of the at least one alkoxide-forming element thereof and to provide electrical insulation consisting essentially of inorganic materials.

21. The process of electrically insulating a part for use in electrical equipment, comprising:

a. applying to the part an electrical insulation preform according to claim 9 to provide an assembly; and b. heating the assembly to pyrolyze the alkoxy gel polymer of the electrical insulation preform to at least one oxide of the at least one alkoxide-forming element thereof and to provide electrical insulation consisting essentially of inorganic materials.

22. The process of electrically insulating a part for use in electrical equipment, comprising:

applying to the part electrical insulation according to claim 11.

* * * * *